US009138806B2

(12) United States Patent
Nabawy et al.

(10) Patent No.: US 9,138,806 B2
(45) Date of Patent: Sep. 22, 2015

(54) IN-SITU COMBUSTION SYNTHESIS OF TITANIUM CARBIDE (TIC) REINFORCED ALUMINUM MATRIX COMPOSITE

(71) Applicants: Ahmed Mohammed Nabawy Nabawy, Riyadh (SA); Khalil Abdelrazek Khalil, Riyadh (SA); Abdulrahman M. Al-Ahmari, Riyadh (SA)

(72) Inventors: Ahmed Mohammed Nabawy Nabawy, Riyadh (SA); Khalil Abdelrazek Khalil, Riyadh (SA); Abdulrahman M. Al-Ahmari, Riyadh (SA)

(73) Assignee: King Saud University, Riyadh (SA)

( * ) Notice: Subject to any disclaimer, the term of this patent is extended or adjusted under 35 U.S.C. 154(b) by 518 days.

(21) Appl. No.: 13/719,498

(22) Filed: Dec. 19, 2012

(65) Prior Publication Data

US 2014/0170013 A1 Jun. 19, 2014

(51) Int. Cl.

| | |
|---|---|
| ***B22F 3/23*** | (2006.01) |
| ***B22F 3/105*** | (2006.01) |
| ***C22C 1/10*** | (2006.01) |
| ***C22C 32/00*** | (2006.01) |
| *C22C 29/10* | (2006.01) |

(52) U.S. Cl.

CPC ..... *B22F 3/105* (2013.01); *C22C 1/1078* (2013.01); *C22C 32/0052* (2013.01); *B22F 2003/1053* (2013.01)

(58) Field of Classification Search

CPC ..... C22C 32/00; B22F 3/105; B22F 1/0081

USPC ..... 419/17, 14; 75/236

See application file for complete search history.

(56) References Cited

U.S. PATENT DOCUMENTS

| | | | | |
|---|---|---|---|---|
| 5,041,263 | A | 8/1991 | Sigworth | |
| 5,698,049 | A | 12/1997 | Bowden | |
| 5,712,029 | A | 1/1998 | Tsugawa et al. | |
| 7,621,435 | B2 | 11/2009 | Vecchio et al. | |
| 7,922,841 | B2 | 4/2011 | Bampton et al. | |
| 7,939,182 | B2 | 5/2011 | Cottignies et al. | |
| 8,083,871 | B2 | 12/2011 | Lin et al. | |
| 2003/0145685 | A1 * | 8/2003 | Owers | 75/765 |

FOREIGN PATENT DOCUMENTS

| | | | |
|---|---|---|---|
| JP | 49078712 | A | 7/1974 |
| JP | 61270376 | A | 11/1986 |
| JP | 3249185 | A | 11/1991 |
| JP | 2009148823 | A | 7/2009 |

OTHER PUBLICATIONS

Lee, Wei-Chang, and Shyan-Lung Chung. "Ignition Phenomena and Reaction Mechanisms of the Self-Propagating High-Temperature Synthesis Reaction in the Titanium-Carbon-Aluminum System." Journal of the American Ceramic Society 80.1 (1997): 53-61. Web. Jun. 29, 2015.*

H.H. Nersisyan, H.I. Won, C.W. Won, Combustion synthesis of WC powder in the presence of alkali salts, Materials Letters, vol. 59, Issues 29-30, Dec. 2005, pp. 3950-3954, ISSN 0167-577X, http://dx.doi.org/10.1016/j.matlet.2005.07.042.*

* cited by examiner (Continued)

*Primary Examiner* — Matthew E Hoban
*Assistant Examiner* — Jeremy Jones
(74) *Attorney, Agent, or Firm* — Lowe Hauptman & Ham, LLP

(57) ABSTRACT

An in-situ process for making aluminum titanium carbide composite materials include the steps of mixing powdered aluminum, titanium and calcium carbonate, compacting the mixture and heating by a high frequency induction heater up to a temperature at which titanium carbide is formed at about 800° C.-1,000° C. The compact are then introduced into a tube furnace under an inert atmosphere such as argon, nitrogen, helium etc. at 1200° C. to 1350° C. for 4 to 7 hours to complete the reaction and optimize the TiC particles.

9 Claims, 9 Drawing Sheets

IN-SITU COMBUSTION SYNTHESIS OF TITANIUM CARBIDE (TIC) REINFORCED ALUMINUM MATRIX COMPOSITE

FIELD OF THE INVENTION

This invention relates to an in-situ combustion synthesis of TiC reinforced aluminum matrix composite and more particularly to a process that incorporates a high frequency induction heater (HFIH) at a high heating rate and a tube furnace with an inert atmosphere to produce TiC reinforced aluminum matrix composite with TiC particles having a spherical shape with particle sizes in the range of 100 nm and 5 μm.

BACKGROUND FOR THE INVENTION

Recent developments in the aerospace, automotive and marine industries have led to new manufacturing techniques and a continuing search for new materials that are characterized by high specific strength and modulus as well as high performance at elevated temperatures. Aluminum-based metal matrix composite materials reinforced by ceramic particulates, particularly titanium carbide, are considered to be promising materials which are characterized by high performance at elevated temperatures. The ceramic particulates are stable and non-dissolvable at temperatures up to the melting point of the aluminum matrix.

The mechanical properties of the aforementioned aluminum matrix composite materials are determined based on the average particle size of the particulates and their shape. The nano-metric spherical particles are recommended for obtaining superior properties at elevated temperatures. In general, the reinforced composites may be made by two different techniques, namely ex-situ and in-situ. In the ex-situ technique, the pre-manufactured ceramic particulates are added to the liquid metal by various fabrication methods such as squeeze casting, pressure infiltration and stirring. However, there is a major challenge with ex-situ manufacturing techniques. The problem relates to the non-wetting nature of ceramics by liquid aluminum.

In in-situ techniques, the surrounding particles are formed throughout the metal matrix by a chemical reaction. The ceramic phase is free of contaminants and a strong bond is formed between the ceramic and the metal phases. The difficulty with in-situ techniques are that the distribution homogeneity and the average particle size of ceramics are difficult to control. However, in in-situ synthesizing titanium as a transition element enters into an exothermic reaction with carbon producing TiC particulates having high coherency and strong interface with the metal as for example aluminum.

U.S. Pat. No. 5,041,263 of Sigworth relates to third element additions to aluminum-titanium master alloys. As disclosed therein, an improved aluminum-titanium master alloy containing carbon in a small but effective content and not more than about 0.1% are provided. After melting, the master alloy is superheated to about 1200°-1250° C. to put the carbon into solution, than the alloy is caste in a workable form. The master alloy in final form is substantially free of carbides greater than about 5 microns in diameter. The alloy is used to refine aluminum products that may be rolled into thin sheets, foil or fine wire and the like.

A more recent U.S. Pat. No. 5,698,049 of Bowden discloses a method for producing aluminum matrix composites containing refractory aluminide whiskers or particulates which are formed in-situ. Aluminum and refractory metal materials are blended in powder form and then heated to a temperature above the melting point of aluminum. A solid/liquid reaction between the molten aluminum and solid refractory metal provides a desired volume fraction of refractory aluminide reinforcement phase (in situ whiskers or particulates). Upon cooling the molten unreacted portion of aluminum solidifies around the in situ reinforcements to create the improved composite materials. As further disclosed the process involves blending together effective amounts of aluminum powder and a refractory metal powder to represent a desired volume fraction of reinforcement phase. This reinforcement phase is formed when a powder pack is placed in a niobium or other suitable can and heated under vacuum to a temperature above the melting temperature of the aluminum. This produces a chemical reaction between the molten aluminum and solid refractory metal powder that results in an in-situ formation of a refractory metal aluminide reinforcement phase. After the reaction is complete and upon cooling to room temperature, the residual unreacted aluminum solidifies and envelopes the reinforcements. The solid composite material is thereafter removed from the can.

A U.S. Patent Appl. Pub. No. 2003/0145685 is entitled "Process for Producing Titanium Carbide, Titanium Nitride, and Tungsten Carbide Hardened Materials." As disclosed, precursor materials are heated to a temperature sufficient to form TiC, TiN or WC but at which the metal phase may softened but does not become molten (liquid). In this way the TiC, TiN or WC are formed in-situ without melting the metal phase. As stated in the aforementioned patent publication, "introducing a ceramic phase into a metal matrix provides characteristic features of each of the resultant products." The ceramic increases hardness and wear resistance but is often brittle, which the metal or metal alloy contributes toughness and durability. However, "wetting" of the ceramic component by the metal to obtain cohesive bonding between the metal or metal alloy and the ceramic component is a major challenge to the preparation of such materials.

Notwithstanding the above, it is presently believed that there is a need and a potential commercial market for a process in accordance with the present invention. There should be a need because the present process provides in-situ formation of titanium carbide in an aluminum matrix composite. Further, such materials produced thereby have improved hardness and wear resistance as well as toughness and durability. In the present process, the ceramic and metals are formed with a cohesive bonding between the metal or metal alloy.

BRIEF SUMMARY OF THE INVENTION

In essence the present invention contemplates a process for the in-situ synthesis of titanium carbide (TiC) reinforced aluminum matrix composite comprising and/or consisting of the following steps.

Masses of aluminum, titanium and calcium carbonate powders are provided and the aluminum and titanium powders mixed and blending the aluminum and titanium powders with a calcium carbonate.

A high frequency induction heater (HFIH) is provided and produces a high heating rate to thereby disassociate the calcium carbonate into carbon dioxide gas and calcium oxide and the carbon dioxide gas is further disassociated and carbon particles formed. In addition, a tube furnace is provided and inert atmosphere added to the tube furnace. Thereafter, introducing the aluminum, titanium and carbon particles into the tube furnace at an elevated temperature under an inert gas atmosphere to form in-situ TiC as a result of an exothermic reaction between titanium and carbon and between titanium aluminide and carbon. The TiC particles formed having a spherical shape with a particle size in the range of 100 nm and 5 μm.

In a preferred embodiment of the invention the powders are mixed and are degassed under a vacuum and the HFIH heats the mixture therein to a temperature of about 800° to 1,000° C. at a rate of about 700° C./min and the aluminum and titanium powders are blended with calcium carbonate in an amount to obtain about 30 vol. % TiC.

The invention will now be described in connection with the accompanying figures.

DETAILED DESCRIPTION OF THE INVENTION

In the current invention, combining powder metallurgy and liquid metal processing techniques are employed to manufacture in situ TiC reinforced aluminum matrix composites. The TiC ceramic particles are in situ synthesized through an exothermic reaction which is activated by heating titanium to an elevated temperature in the presence of calcium carbonate as a carbon source. The ceramics in situ synthesized in the metal matrix are distinguished by a strong interface with the metal matrix.

Materials:

Aluminum (99.7%) in powder form with an average particle size of 10 μm

Titanium (99.7%) with an average particle size of 10 μm

Calcium carbonate with an average particle size of 2 μm

Procedures of Manufacturing Process:

Procedure No. 1. Mixture Preparation

Figure 1:
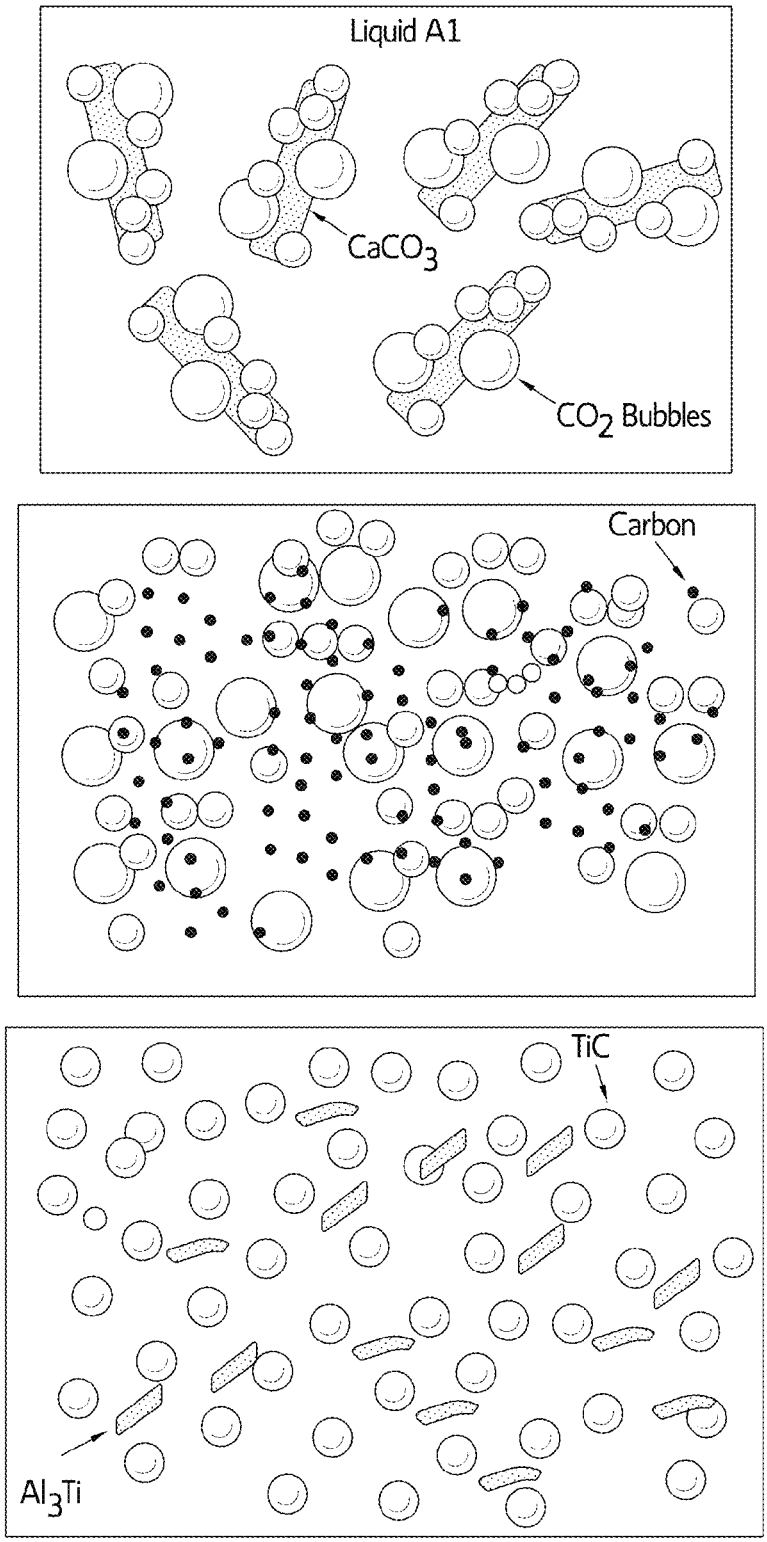
FIG. 1 is a schematic illustration of the synthesizing process sequence of an in-situ TiC reinforced aluminum matrix composite.
Figure 2:
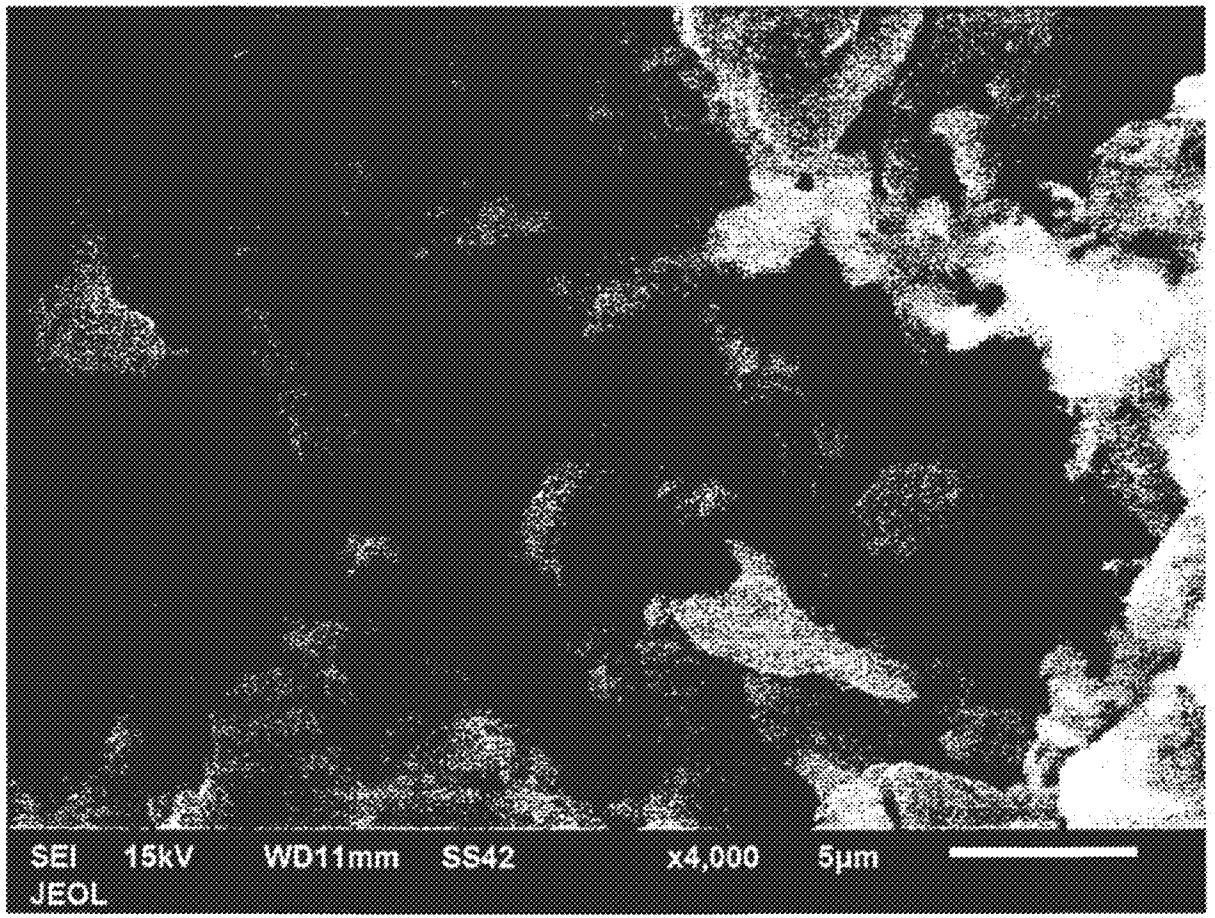
FIG. 2 is a secondary electron image of the aluminum particulates produced by a process of the present invention.
Figure 3:
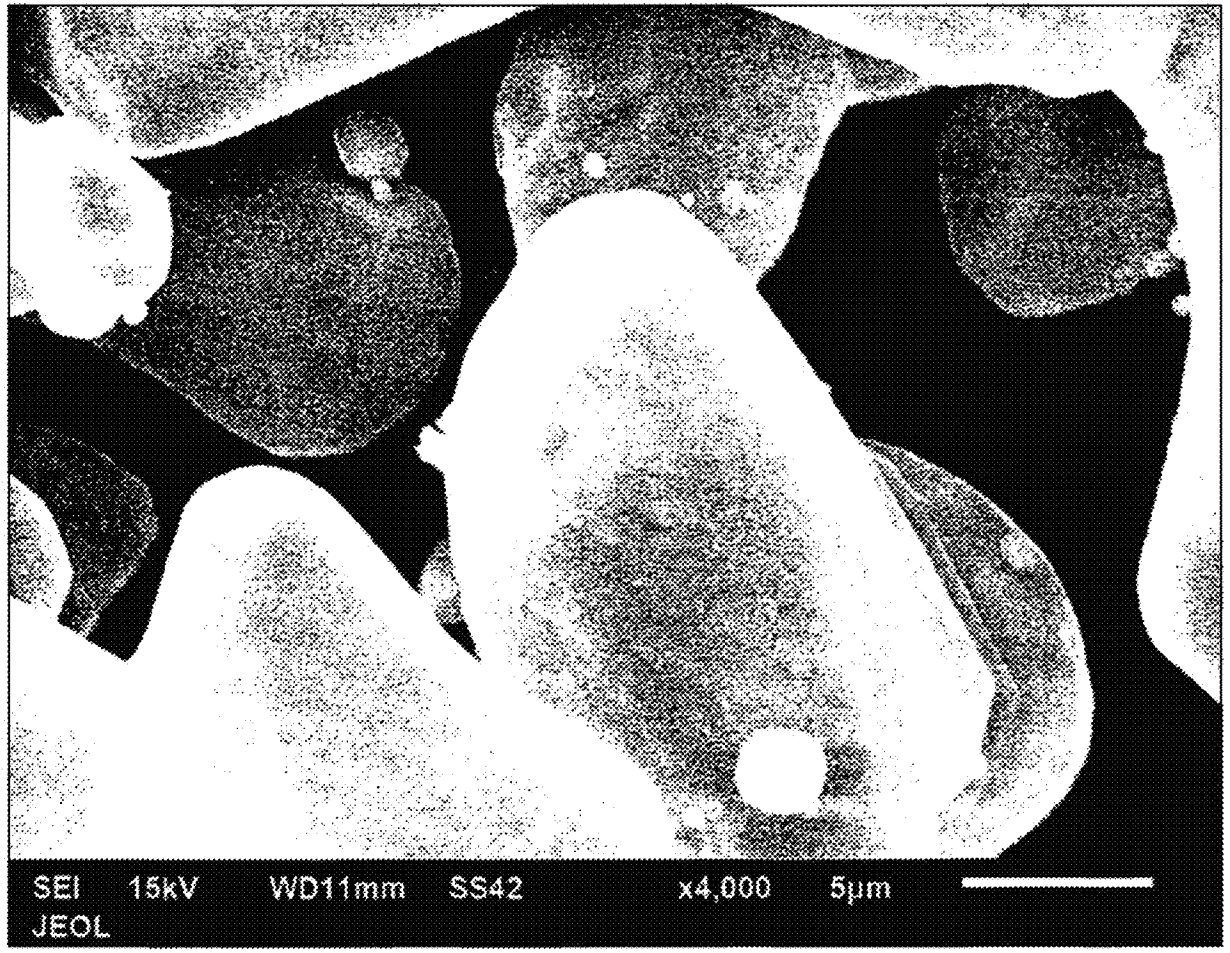
FIG. 3 is a secondary electron image of titanium particles.
Figure 4:
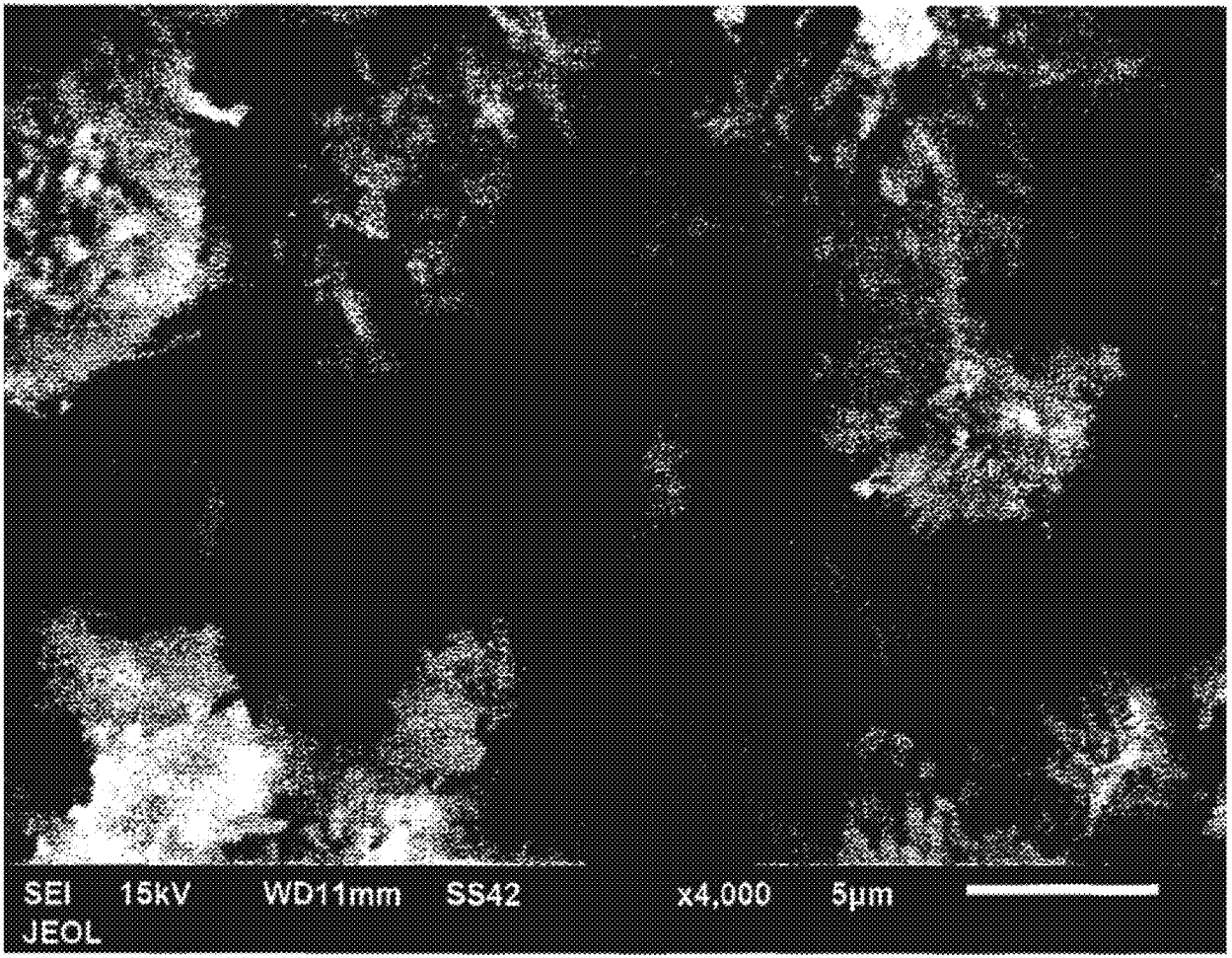
FIG. 4 is a secondary electron image of calcium carbonate particulates.

The synthesizing process of Al—TiC composites is started by blending of the reactants powders of aluminum, titanium, and calcium carbonate at designated amount of 40 Wt %, 48 Wt %, and 12 Wt %, respectively. The reactants powders which are used have different particle morphologies and sizes as can be seen in FIGS. 2 to 4.

The blending process may be conducted using ultrasonic or ball milling to achieve an elevated level of homogeneity. The ball milling is preferred in order to break down the oxide layers covered the aluminum and titanium particles which may delay the formation reaction of TiC. The produced TiC particles size and the level of their distribution throughout the aluminum matrix can be optimized by controlling the particle size and the addition level of calcium carbonate.

The blended powders are degassed under vacuum of about $1\times10^{-3}$. The heating temperature of 200° C. is carried out to drive the entrapped gases and moisture from the powders. This degassing process is carried out to avoid the pores formation and the presence of impurities in the manufactured composite material. During the degassing process, the vacuum pressure changes due to the releasing of the gases and moisture.

Procedure No. 2. Hot Compaction

Figure 9A:
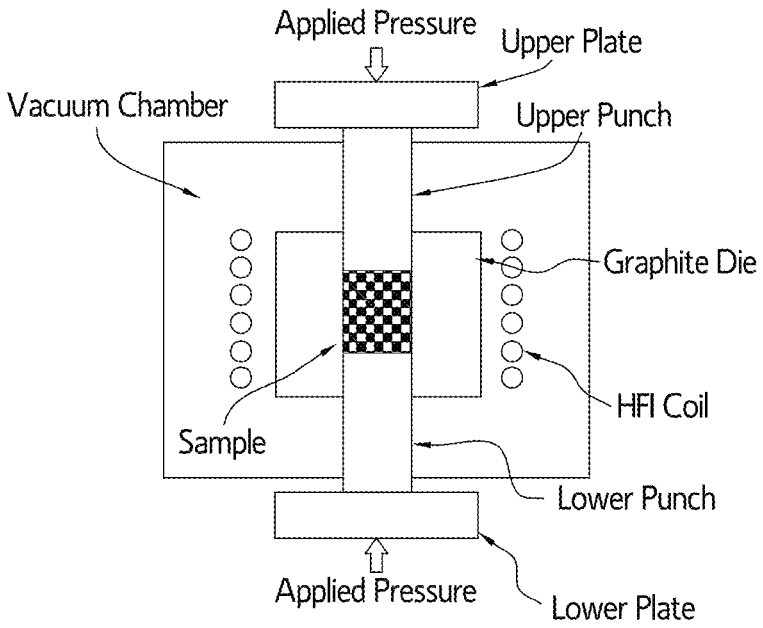
FIG. 9 is a schematic diagram of a high frequency induction heated sintering apparatus, (b) photo of the heated die.
Figure 9B:
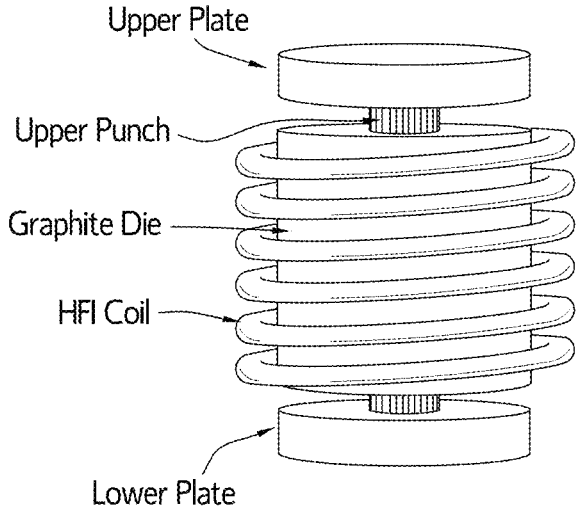

The blended powders were placed in a graphite die and then introduced into the high-frequency induction heating apparatus (HFIH). The basic configuration of an HFIH unit is shown in FIG. 9. The unit consists of a uniaxial pressure device and a graphite die (outside diameter, 45 mm, inside diameter, 20 mm; height, 40 mm). The unit also features a water-cooled reaction chamber that can be evacuated, induced current (frequency of approximately 50 kHz) and pressure-, position- and temperature-regulating systems. HFIH resembles the hot pressing process in several respects, i.e., the precursor powder is loaded in a die, and uniaxial pressure of between 50 MPa-200 MPa is applied during the sintering process. However, instead of using an external heating source, an intense magnetic field is applied through the electrically conducting pressure die and, in some cases, also through the sample. Thus, the die also acts as a heating source, and the sample is heated from both the outside and inside. Temperatures can be measured using a pyrometer focused on the surface of the graphite die. In this work, the uniaxial pressure is applied and an induced current (frequency of approximately 50 kHz) is then activated and maintained until densification, indicating the occurrence of sintering and the concomitant shrinkage of the sample is observed. Sample shrinkage is measured by a linear gauge that measures the vertical displacement.

The compaction process, that represents the first synthesizing stage of TiC in this work, is applied to increase the contacted area among the different powders and reduce the escaping of carbon dioxide gas during the heating process, in addition to introducing of the carbon particulates into the aluminum matrix. In the compaction process the mixed powders are heated into a temperature range 800° C.-1000° C. using high heating rate of 700° C./min, and under the application of the pressure range of 50 MPa-200 MPa. As the temperature exceeds the 850° C., the calcium carbonate is dissociated into carbon dioxide which in turn, enriches the aluminum matrix by carbon. The holding time at the heating temperature range will not exceed 7 min.

Procedure No. 3. In situ Synthesizing of TiC

In the second stage, after HFIH, the samples are placed in a tube furnace under inert gas atmosphere (argon gas) to minimize oxidation possibility. Sufficient holding time (as an example, is 4 to 7 hours at temperature range of 1200° C. to 1350° C.) is essential to complete the reaction and optimize the TiC particles formation. At this temperature range the TiC particulates form as a result of a series of reactions that occurred in the aluminum melt.

The expected reaction sequences are started during the heating by the formation of titanium trialuminide followed by an exothermic reaction between pre-formed carbon with titanium and titanium trialuminide in two separated reactions producing the titanium carbide particulates. Those chemical reactions are as follows:

$$Al+Ti\rightarrow Al_3Ti \quad (1)$$

$$Ti+C\rightarrow TiC \quad (2)$$

$$Al_3Ti+C\rightarrow TiC+3Al \quad (3)$$

Figure 5:
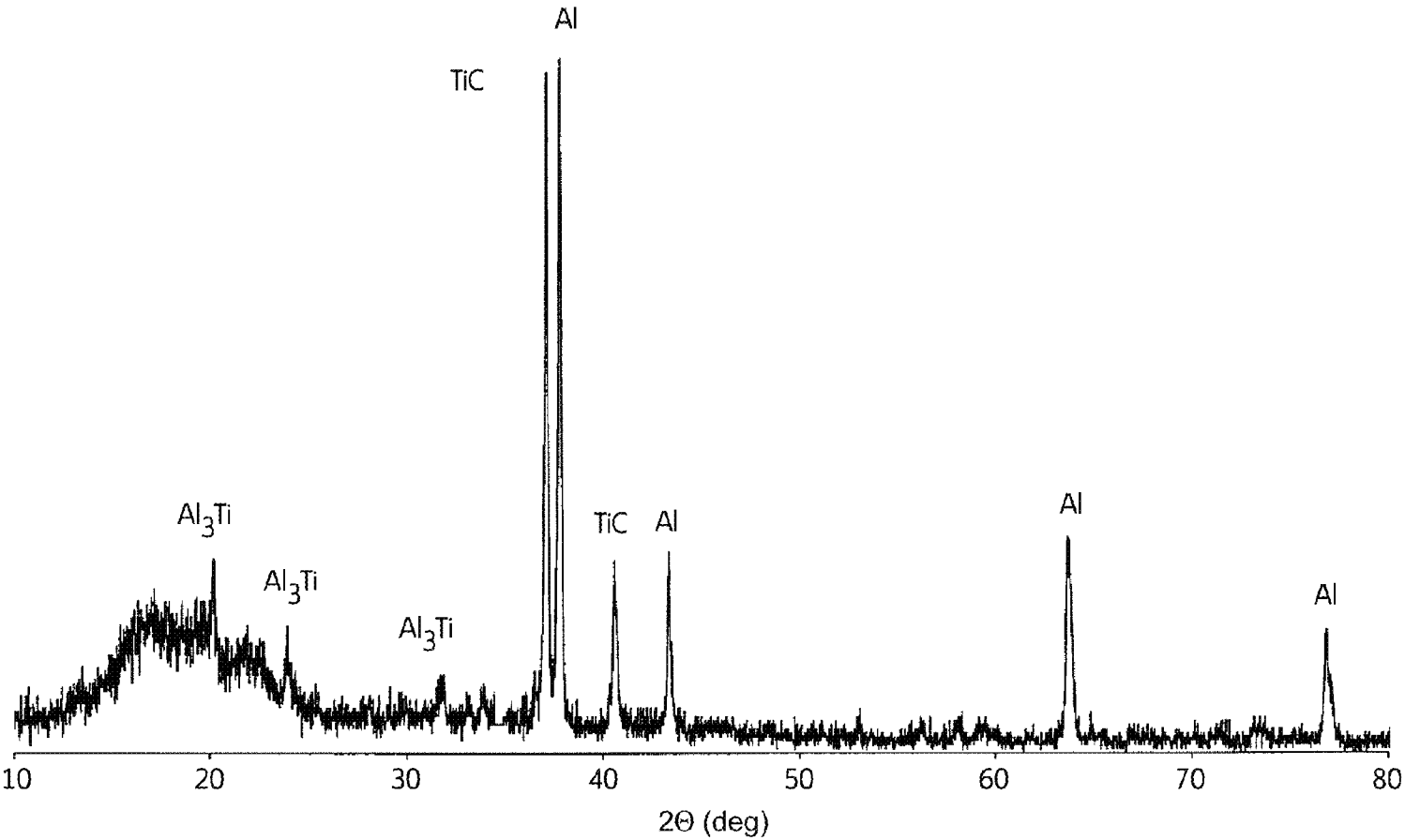
FIG. 5 is a chart of the x-ray diffraction pattern of Al—TiC composite material representing different peaks belonging to TiC, $Al_3Ti$, and aluminum.

The X-ray analysis indicates the formation of TiC and $Al_3Ti$ intermetallics in the aluminum matrix (FIG. 5).

Figure 6:
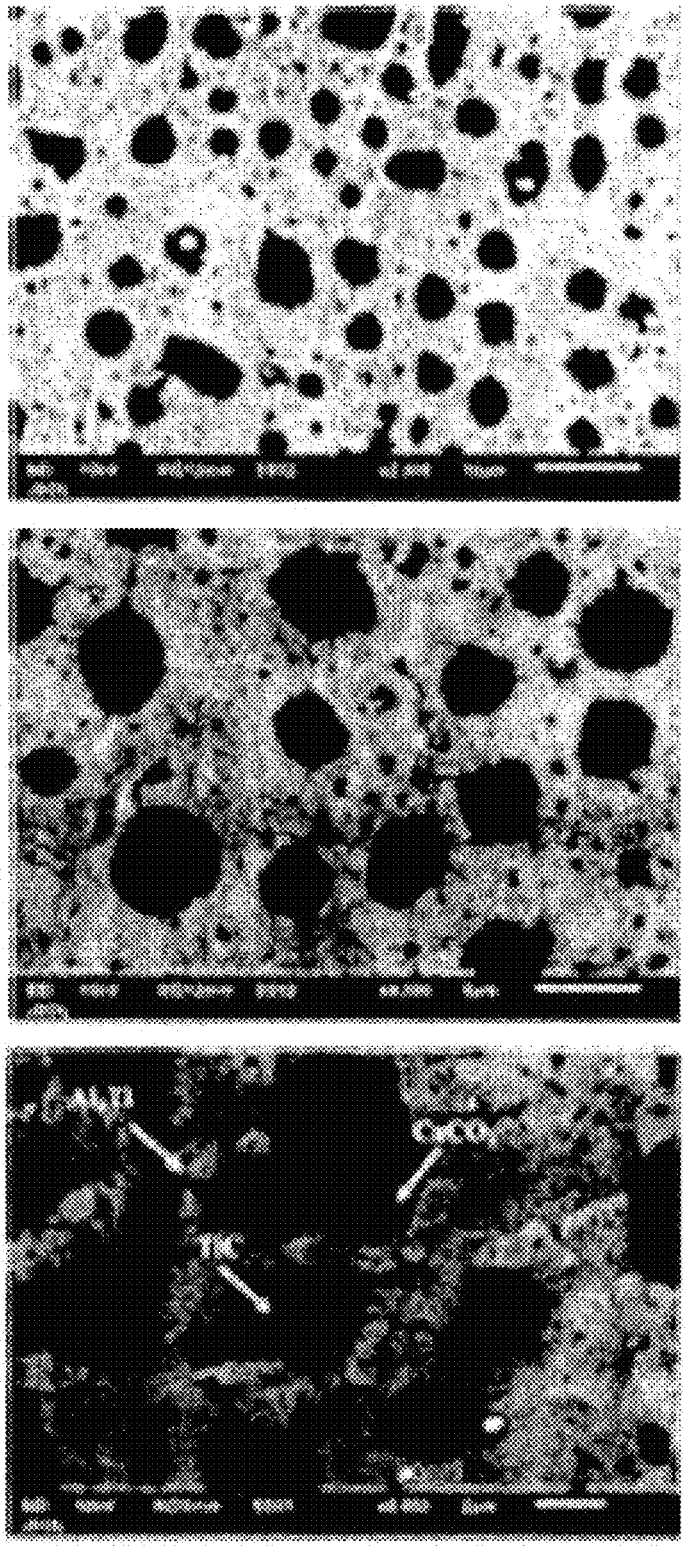
FIG. 6 shows different magnifications of SEM micrograph for TiC particles in-situ synthesized throughout an aluminum matrix.
Figure 7:
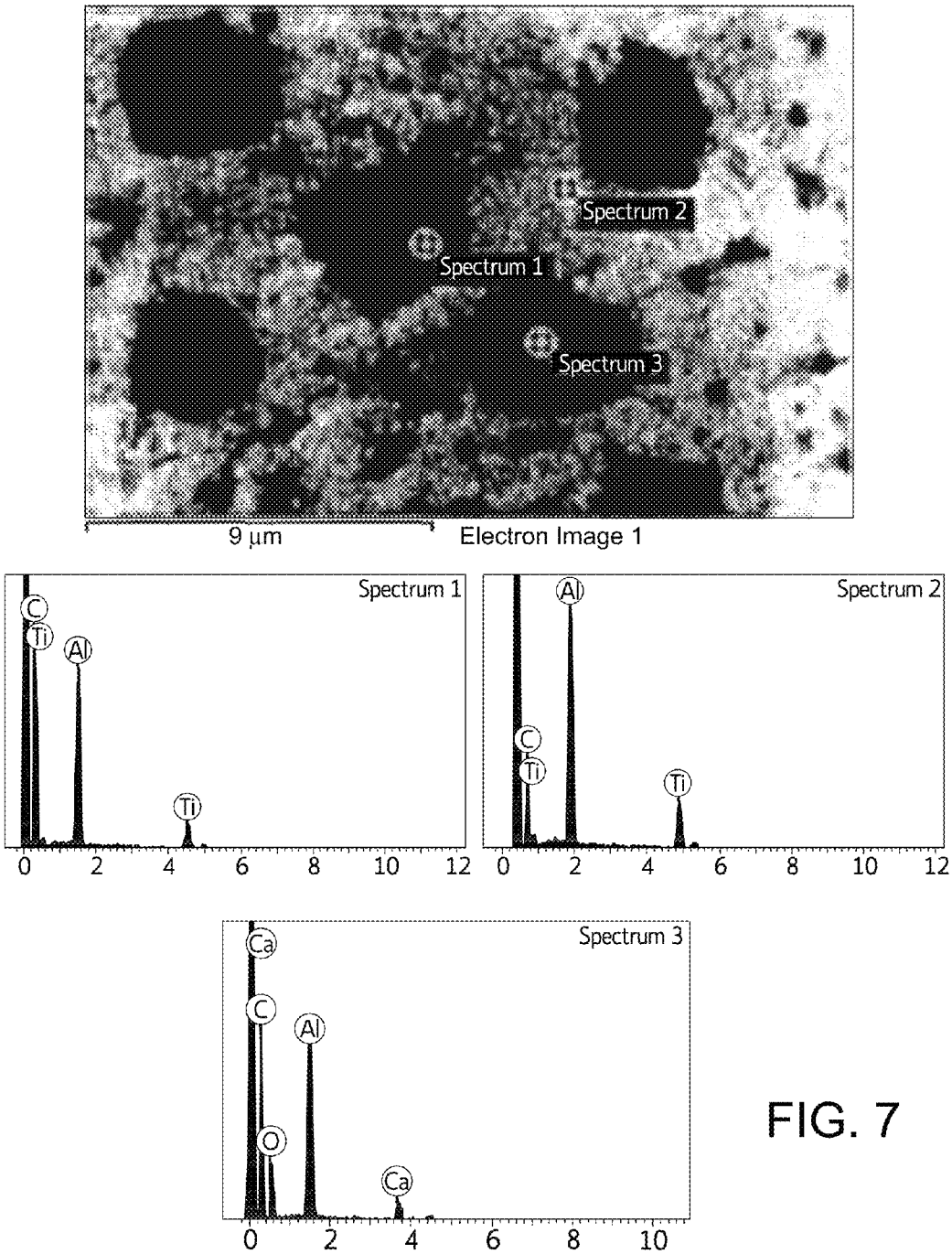
FIG. 7 presents an EDX analysis for different regions in Al—TiC composite materials.
Figure 8:
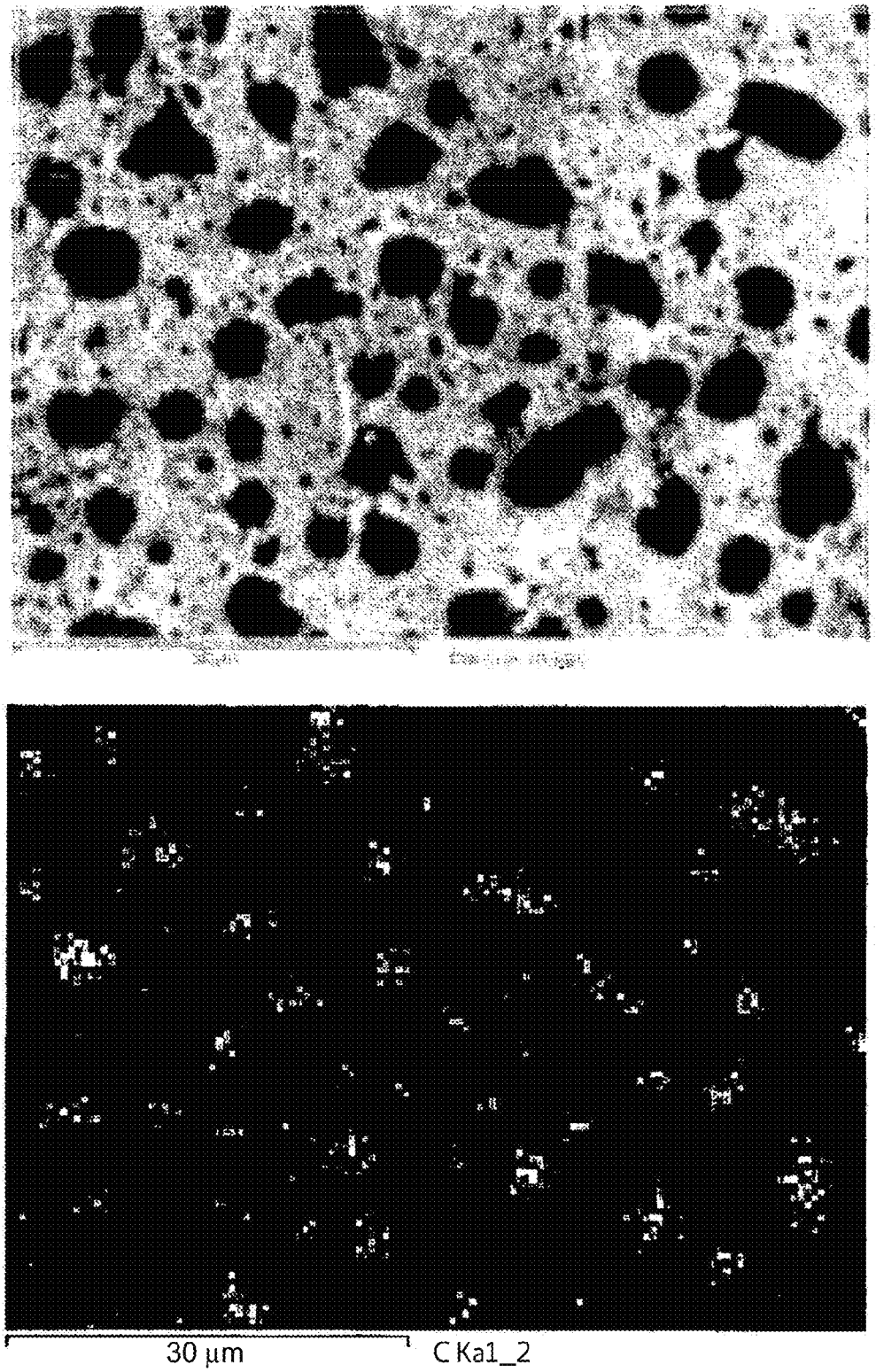
FIG. 8 is an x-ray mapping of carbon detected throughout TiC particulates.

The microstructural analyses represent the formation of TiC particulates having spherical morphology at different sizes in the range of 5 μm-100 nm, as shown in FIGS. 6-8. The in-situ TiC particulates form a coherent interface with the aluminum matrix as may be seen in FIG. 6; this indicates the high reinforcing effects of TiC particulates practiced on the aluminum matrix.

FIG. 7 represents the Energy-dispersive x-ray spectroscopy (EDX) analysis at different regions throughout the Al—TiC composite material. The EDX analysis detects the presence of the calcium carbonate in the core of the TiC particulates; this indicates that titanium and titanium trialuminide react with the produced carbon spontaneously and simultaneously during dissociation of the calcium carbonate. Also it can be seen that the carbon and Titanium are detected throughout the matrix which may be attributed to the formation of very tiny TiC particulates in few nanos and also to the formation of titanium trialuminide.

The X-ray mapping of carbon only is detected for the TiC particulates throughout microstructure of the Al—TiC composite, as shown in FIG. 8. The X-ray mapping detection of titanium is neglected because the titanium spread everywhere through the microstructure due the formation of titanium trialuminide with high density throughout all of the microstructure.

It is worth to mention that the manufactured Al—TiC composite can be used as a master alloy to incorporate the TiC particulates into the aluminum and magnesium alloys in order to avoid the poor wetting natural between the TiC ceramics and liquid aluminum and magnesium.

While the invention has been disclosed in connection with its preferred embodiments it should be recognized that changes and modifications may be made therein without departing from the scope of the claims.

What is claimed is:

1. A process for the in-situ synthesis of titanium carbide (TiC) reinforced aluminum matrix composites, said process comprising the steps of:

providing masses of aluminum, titanium and calcium carbonate powders;

mixing the aluminum and titanium powders and blending the aluminum and titanium powders with the calcium carbonate;

providing a high frequency induction heater (HFIH) at a high heating rate to thereby disassociate the calcium carbonate into carbon dioxide gas ($CO_2$) and calcium oxide and the carbon dioxide gas disassociates and carbon particles form;

providing a tube furnace with an inert atmosphere; and introducing the aluminum, titanium and carbon particles into the tube furnace at an elevated temperature under an inert gas atmosphere and forming in-situ TiC as a result of an exothermic reaction between titanium and carbon and between titanium aluminide and carbon and wherein the TiC particles have a spherical shape with a particle size in the range of 100 nm and 5 μm.

2. A process for the in-situ synthesis of titanium carbide (TiC) reinforced aluminum matrix composites according to claim 1, in which the mixed powders are degassed under a vacuum and the HFIH heats the mixture therein to a temperature of about 800 to 1000° C. at a rate of about 700° C./min and the aluminum and titanium powders are blended with $CaCO_3$ in an amount to obtain about 30 vol % TiC.

3. A process for the in-situ synthesis of titanium carbide (TiC) reinforced aluminum matrix composites according to claim 2, in which said mixture of aluminum and titanium powder is blended with calcium carbonate powder and compacted while heating in a high frequency induction heater.

4. A process for the in-situ synthesis of titanium carbide (TiC) reinforced aluminum matrix composites according to claim 3, in which said composites contain about 30 vol. % of TiC.

5. A process for the in-situ synthesis of titanium carbide (TiC) reinforced aluminum matrix composites according to claim 4, in which the aluminum, titanium and calcium carbonate are provided in amounts of 40 wgt %, 48 wgt % and 12 wgt %, respectively.

6. A process for the in-situ synthesis of titanium carbide (TiC) reinforced aluminum matrix composites according to claim 5, in which the aluminum, titanium and calcium carbonate have the following particle sizes 10 μm, 10 μm and 2 μm, respectively.

7. A process for the in-situ synthesis of titanium carbide (TiC) reinforced aluminum matrix composites according to claim 6, in which said powders are degassed in an HFIHS chamber under a vacuum of $1\times10^{-3}$ Torr following the compaction of the powders.

8. A process for the in-situ synthesis of titanium carbide (TiC) reinforced aluminum matrix composites according to claim 7, in which said compacted powders are placed in the tube furnace at a temperature of between 1,200° C.-1,350° C. for a period of 4-7 hours.

9. A process for the in-situ synthesis of titanium carbide (TiC) reinforced aluminum matrix composites according to claim 8, in which in the compaction process, the mixed powders are heated to a temperature within the range of 800° C.-1,000° C. using a high heating rate of 700° C./min and under the application of pressure within the range of 50 MPa-200 MPa is applied and wherein the holding temperature at 800° C.-1,000° C. does not exceed 7 minutes.

* * * * *